US007204208B2

(12) United States Patent
Johnson et al.

(10) Patent No.: US 7,204,208 B2
(45) Date of Patent: Apr. 17, 2007

(54) METHOD AND APPARATUSES TO REMOVE SLAG

(75) Inventors: Samuel A. Johnson, Loveland, CO (US); Daniel S. Johnson, Loveland, CO (US)

(73) Assignee: S.A. Robotics, Loveland, CO (US)

( * ) Notice: Subject to any disclaimer, the term of this patent is extended or adjusted under 35 U.S.C. 154(b) by 304 days.

(21) Appl. No.: 10/464,362

(22) Filed: Jun. 17, 2003

(65) Prior Publication Data

US 2004/0255872 A1 Dec. 23, 2004

(51) Int. Cl.
*F22B 37/20* (2006.01)

(52) U.S. Cl. ..... 122/379; 134/167 R; 15/316.1

(58) Field of Classification Search ..... 122/379–390, 122/393; 134/18, 22.11, 22.12, 167 R–167 C, 134/168 R; 15/316.1, 318; 239/422, 418, 239/381, 424.5, 433

See application file for complete search history.

(56) References Cited

U.S. PATENT DOCUMENTS 5,069,172 A * 12/1991 Shirey et al. ..... 122/382
H1115 H * 12/1992 Nachbar ..... 165/11.1
5,172,653 A * 12/1992 Vadakin ..... 122/392
5,564,371 A * 10/1996 Ashton et al. ..... 122/392
5,579,726 A * 12/1996 Finucane ..... 122/379
5,769,035 A * 6/1998 Fiedler ..... 122/384
6,412,449 B1 * 7/2002 Reid et al. ..... 122/379
6,672,257 B1 * 1/2004 Ashton et al. ..... 122/379
6,681,839 B1 * 1/2004 Balzer ..... 165/11.2

* cited by examiner

*Primary Examiner*—Gregory Wilson
(74) *Attorney, Agent, or Firm*—Holland & Hart LLP

(57) ABSTRACT

A robotic apparatus for the cleaning and maintenance of coal fired boilers, which is designed to operate in the high temperature environment of the combustion gasses to effectively clean and remove slag deposits of the boiler heat transfer surfaces by use of a precision directed, low pressure, low flow rate water stream. The robotic cleaning apparatus is comprised of lightweight carbon fiber structural elements, attached to the exterior of the boiler, and cooled by annular pressurized water sheaths impingent on a thin metal skin covering the lightweight structural elements. Multiple articulated joints allow for complete access to the heat transfer surfaces of the boiler. A variety of payloads can be delivered to specific points within the boiler, including imaging systems, cutting, and welding apparatuses. A mathematical state space control matrix allows for optimal positioning and feedback control of motions.

23 Claims, 21 Drawing Sheets

METHOD AND APPARATUSES TO REMOVE SLAG

FIELD OF THE INVENTION

The present invention relates to electric power generation, power plant maintenance, and, more particularly, to maintain coal fired boilers, and to remove slag from boilers in steam generation plants, and to reduce boiler damage and boiler cleaning down time.

BACKGROUND OF THE INVENTION

Coal fire generation plants use a boiler containing closely placed tubes. For more efficient heat exchange, and power generation, the tubes need to remain relatively clean. Clean tubes allow for better heat exchange across the tubes, which cause more efficient power generation. Additionally, heat transfer tubes require repair and maintenance, due to the extreme nature of the combustion, chemical, and metallurgical processes involved in the production of high pressure, high temperature steam.

During operation of power plants, and particularly coal-fired plants, the heat exchange tubes become coated with slag. Current methods and apparatuses to clean the slag require either high-pressure water canons, explosive charges, or people to enter the boiler and blast the slag from the tubes. In other words, the boiler needs to be shut down and cooled until a maintenance operation can effectively clean the slag from the tubes. The cleaning process can use hydraulic water jets, explosives, and even scrubbing. During the cleaning, the boiler is not operating, and the plant is losing revenue.

It is not unusual for any particular boiler to be shut down for cleaning several times a year. Further, each shut down can last up to 7 or more days. Shutting down a boiler for cleaning can negatively impact a plant's revenue by several million dollars annually.

Although the exact causes of increased slag deposits in boilers are not completely understood, it is believed the lower quality fuel play a role in extended shutdowns. Many boilers were designed for high yield BTU/lb coal, but currently available coal is of less yield BTU/lb. For example, coal from Wyoming's Powder River Basin is rated for a yield of 8500 BTU/lb, which is below the yield most plants were designed for, and has large amounts of contaminants in the form of silicates, minerals, non-combustibles, etc. These vaporize/melt in the combustion zone, and re-condense out on the coolest part of the tubes in the gas stream. This accumulated slag constricts airflow, insulates and damages tubes, and reduces boiler efficiency.

The commonly practiced methods of boiler cleaning and comprise:

1. Hydro-Blasting. A 10,000-psi, 120–130 gpm water jet is delivered thru the access portals with a hand directed water lance. Access is limited to line of sight, and precision is poor. Excessive thermal shocking may damage the adjacent tubes. Effectiveness is good for large slag deposits, but poor for those out of line of sight or captured between tubes. Damage such as tube leaks and tube bending are directly attributable.

2. Explosive Blasting. This process mandates taking the boiler off-line, and inserting explosive charges very near the accumulated slag. It is believed this explosive force can also be fracturing/bending/and damaging the tubes.

3. Load Shedding. Approximately every 48 hours of peak generating (assuming a 350 MW boiler), the plant is throttled to 200 MW for 6+ hours to create a thermal fracturing of the accumulated slag. This is sometimes referred to as thermal cycling. Even with on-line deslagging attempts, it is necessary to also employ the above methods. It is unknown, but suspected, that constant thermal cycling contributes to long-term boiler failures. Thus, it would be desirable to clean the slag from a boiler without the need to shut down and/or cool down the boiler.

4. Use of many installed sootblowers, such as manufactured by Diamond Power International, or Clyde Bergemann, Inc. These devices are generally rail mounted long lances which periodically insert into the boiler cavity for short durations, and blow high pressure steam, air, or water against the waterwalls of the boiler immediately adjacent to their penetration point. They have a major limitation in that they only can clean a relatively small circular area in the immediate vicinity of their penetration point, and have no capability for deployment to other portions of the boiler for cleaning.

For the repair and maintenance of said boilers, it is customary to cease combustion and allow the interior of the boiler to cool for several days whereupon human craft personnel will enter, erect scaffolding, and use traditional methods of metal cutting, grinding, and welding to repair the damaged steam tubes. This process is not only time consuming and tedious, but is also an inherently dangerous activity.

SUMMARY OF THE INVENTION

The present invention comprises the design, construction and operation of a remotely operated system to inspect, maintain, and de-slag the interior heat transfer pipes of a boiler. The present invention has numerous advantages over the prior art, including remote operation in temperature environments exceeding 2600 degrees Fahrenheit, using a directed, low pressure, low flow water stream positioned in very close proximity to the boiler tubes to eliminate tube damage and erosion, and the capability of being positionable to any desired location within the interior of an operational boiler. Another advantage includes the ability to provide close-up imaging and inspection of critical boiler elements. Another advantage is the remote deployment of a variety of maintenance tools, such as cutting torches, grinders, and welders to be used for boiler maintenance. Yet another advantage is the ability to replace dozens of ineffective and unreliable soot blowers per boiler with a single cleaning solution. Yet another advantage of the present invention is remote and completely automated operation without operator intervention. Still other advantages include slight or minimal modifications to the boiler structural elements or access portals, and the ability to be installed and operational in short order. These and other advantages will be made apparent in the following specifications and detailed description which follows

DETAILED DESCRIPTION OF THE PREFERRED EMBODIMENTS OF THE INVENTION

Figure 1:
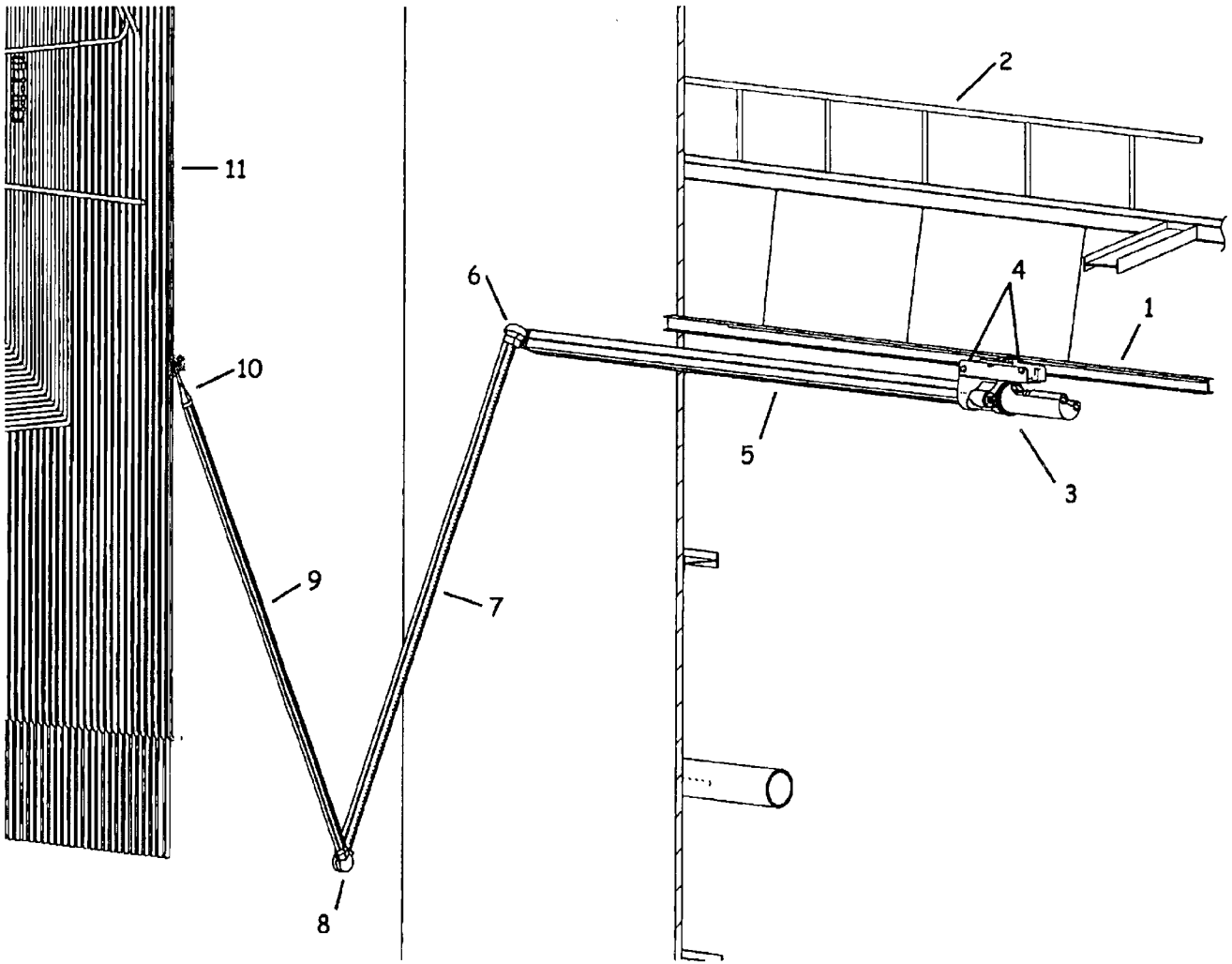
FIG. 1 shows a schematic view of the boiler cleaning robotic arm, demonstrating the boiler cleaning robotic arm fully extended into the interior of a boiler. Omitted for clarity are the details of skin cooling apparatus.

Referring initially to FIG. 1, a boiler cleaning system employing generally the concepts of the present invention is shown schematically. An external linear mounting rail 1 is to be permanently or temporarily attached to existing boiler support structural framework of the boiler 2. Traversing carriage 3 is fitted to linear mounting rail 1 so as to traverse by motorized control the length of linear mounting rail 1. Bearing wheels 4 are closely fitted to minimize the lash, or slop, of traversing carriage 3 to rail 1, so as to minimize deflections of the subsequent mounting apparatus under conditions of high moment creation. Ultra-lightweight main mast assembly 5 is fitted into traversing carriage 3, so as to allow precise rotation and control of the rotational position of main mast assembly 5. Details of the mechanism to accomplish this are presented later in this specification. Fitted to the opposite end of main mast assembly 5 is rotational shoulder joint 6, to which is additionally affixed an ultra-lightweight bicep boom 7. Joint 6 comprises a high stiffness, high moment carrying bearing and gear reduction assembly so as to be easily driven by either electric motor or hydraulic motor, or cable type apparatus. It is generally operable in a single rotational degree of freedom rotational plane. Fitted to the opposite end of the ultra-lightweight bicep boom 7 is a lightweight, rotational elbow joint 8, also generally operable in a single rotational degree of freedom rotational plane. Fitted to rotational elbow joint 8 is an ultra-lightweight fore-arm boom 9. The general dimensions of fore-arm boom 9, bicep boom 7, and main mast 5 are dependant on the boiler to be maintained and cleaned, but are generally on the order of 10 feet to 25 feet per length of section. Such an articulated, jointed robot arm configuration can allow a reach of a tip 10 of fore-arm boom 9 in excess of 80 feet within said boiler. Attached to the tip 10 of the heretofore described robot arm, can be a variety of end effectors suited to the maintenance and cleaning tasks of said boiler. These remotely controlled end effectors can comprise specialized tools for cutting, grinding, welding, and inspecting.

For the task of cleaning slag deposits attached directly and tenaciously to the heat transfer tubes of the boiler, a low pressure, low flow directional water lance can be attached to the present invention and be directed against such deposits for effective cleaning and removal of slag. This particular process will be further described later in this specification.

Figure 10:
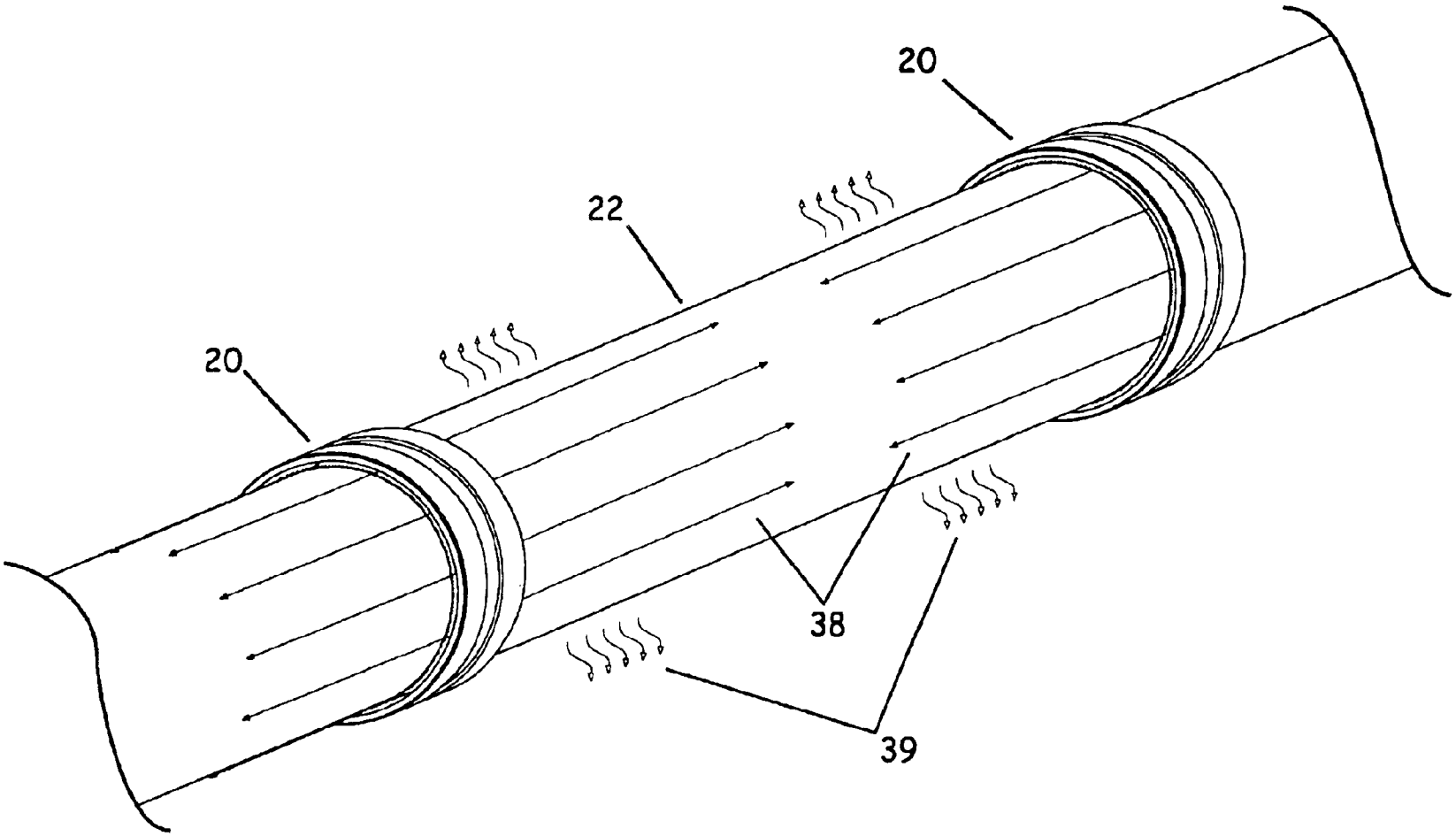
FIG. 10. shows an isometric view of the details of skin cooling apparatus of the present invention.
Figure 11:
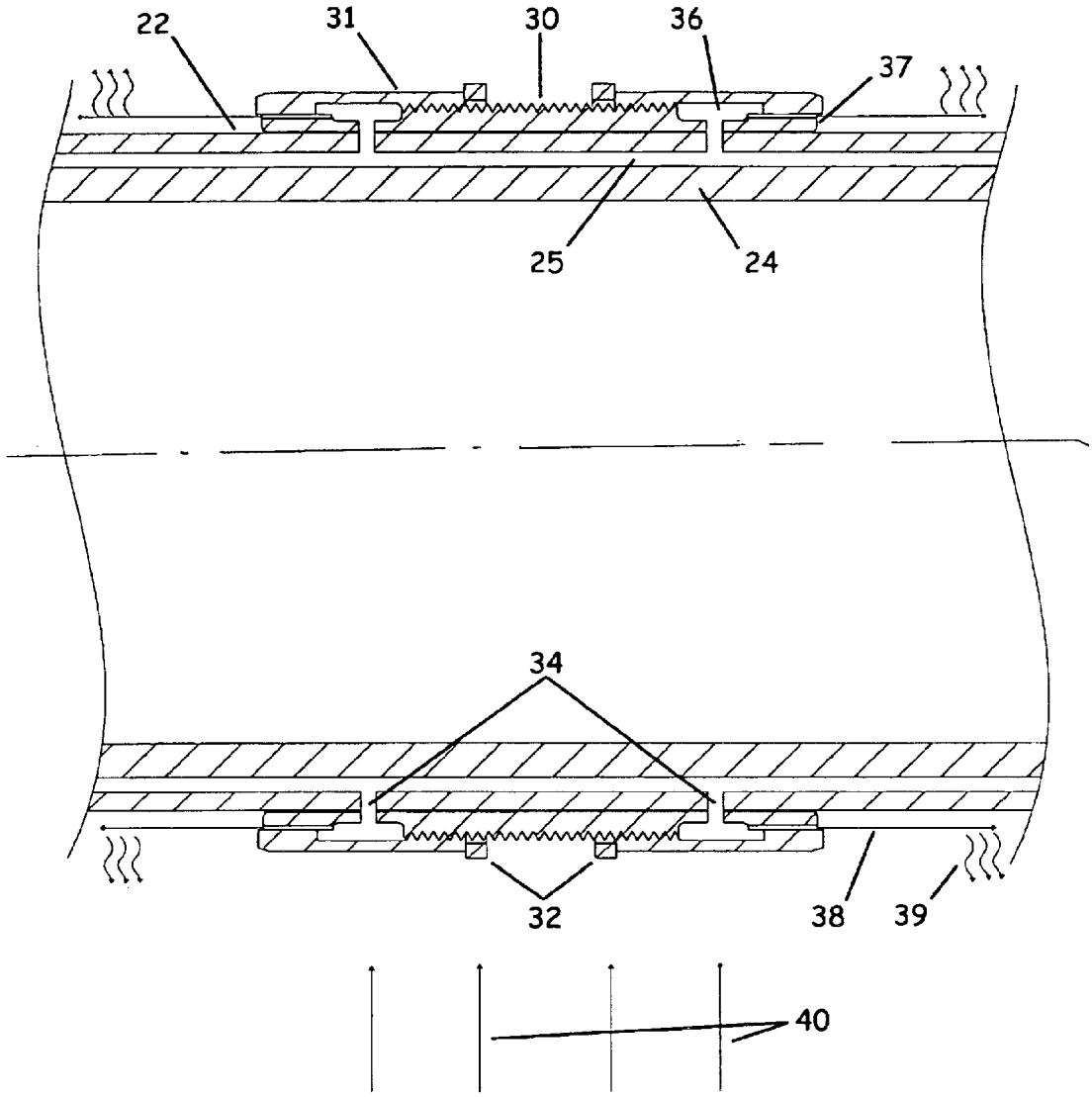
FIG. 11. shows a cross sectional view of a representative water cooling ring.

Referring to FIG. 10, there is shown a cooling system which allows the present invention to operate in-situ within the boiler, meaning while the normal combustion processes and temperatures are present within the boiler. Spray nozzle rings 20 are spaced periodically along the length of each of the articulated arm members 5, 7, and 9 of FIG. 1, although not shown in FIGS. 1–6 for reasons of clarity. The purpose of spray nozzle ring 20 is to spray a thin annulus or jets of water 38 aligned with and adjacent to the exposed exterior surfaces 22, FIG. 10. Such spray nozzle 20 is detailed in a cross sectional view of FIG. 11. Referring to FIG. 11 there is shown a structural, load and moment bearing member 24, which typically comprises the robotic arm elements 5, 7, and 9, all of FIG. 1. Additionally, there exists an annular thin walled section of metallic skin 22 about the entire length of structural elements 5, 7, and 9 respectively, to form a high pressure water passageway 25 around the entire interior circumference of metallic skin 22. Comprising cooling ring 20 of FIG. 10, consists of threaded inner plenum sealing collar 30, threaded locking rings 32, and threaded outer plenum containment ring 31. Drilled water passages 34 carry the water from high pressure passageway 25 into cooling ring plenum 36. Many small diameter holes, on the order 0.020 inches on diameter, are machined along the exterior face 37 of inner plenum sealing collar 30, so as to create high velocity water streams 38. These streams completely surround and envelop the surface of skin 22, and provide an evaporative cooling sheath of water and water vapor which will carry away the heat of the combustion gasses passing over the structure at high velocity. Also, it is possible to design a variety of other means to create a water sheath which can essentially completely surround and envelop the surface of skin 22. This would include the creation of a thin annular orifice spanning 360 degrees between inner plenum sealing collar 30 and outer plenum containment ring 31. Also other means for issuing forth high velocity water are well known in the art, including semi-permable skin type structures which would contain a vast myriad of small pores or holes which would cause the outer surface of skin 22 to be always wetted, and thus protected by the effects of heat removal by phase change from liquid to gas as the combustions gasses impinge. These combustion gasses are typically 2600–2700 degrees Fahrenheit, and traveling in at speeds in excess of 60 miles per hour. Therefore, in the preferred embodiment, it is necessary that such high temperature winds do not separate or diverge the array of water streams 38 from the surface to be cooled 22.

This is accomplished by ensuring streams 38 are directed parallel to the surface to be cooled, at a distance away from the surface of not much greater than one eighth of an inch. Such an annulus of water created by the plurality of water streams 38 also perform another important function of carrying away condensed slag from the high temperature gas stream before it can attach to the exterior surface 22. This is particularly important, since many western US coals from the Powder River Basin mines of Wyoming, USA, contain high percentages of non-combustible silicate contaminants, which when burned, vaporize in the high temperature combustion gasses. They subsequently re-condense at temperatures below about 1400 degrees Fahrenheit. Of course, since all of the boiler interior heat transfer tubes are below this temperature, these combustion contaminants condense to form a tenacious and ever increasing source of slag. Thus, for boilers burning this type of coal, this problem becomes very severe. The structure of the present invention avoids this slag accumulation by virtue of the high velocity water streams 38. This is accomplished as high temperature combustion gasses 40 traverse over water streams 38, thus evaporating them to provide a protective outwardly flowing steam annulus 39 as shown. Since protective outwardly flowing steam annulus 39 is at substantially 212 degrees Fahrenheit, the non-combustible silicate contaminants will condense as slag droplets and be carried away by high velocity water streams 38 and outwardly flowing steam annulus 39. Thus, the structure encased by water streams 38 are protected from the high temperatures, and from slag accumulation. It has been measured that structures protected in such a manner will seldom exceed 120 degrees Fahrenheit.

Figure 12A:
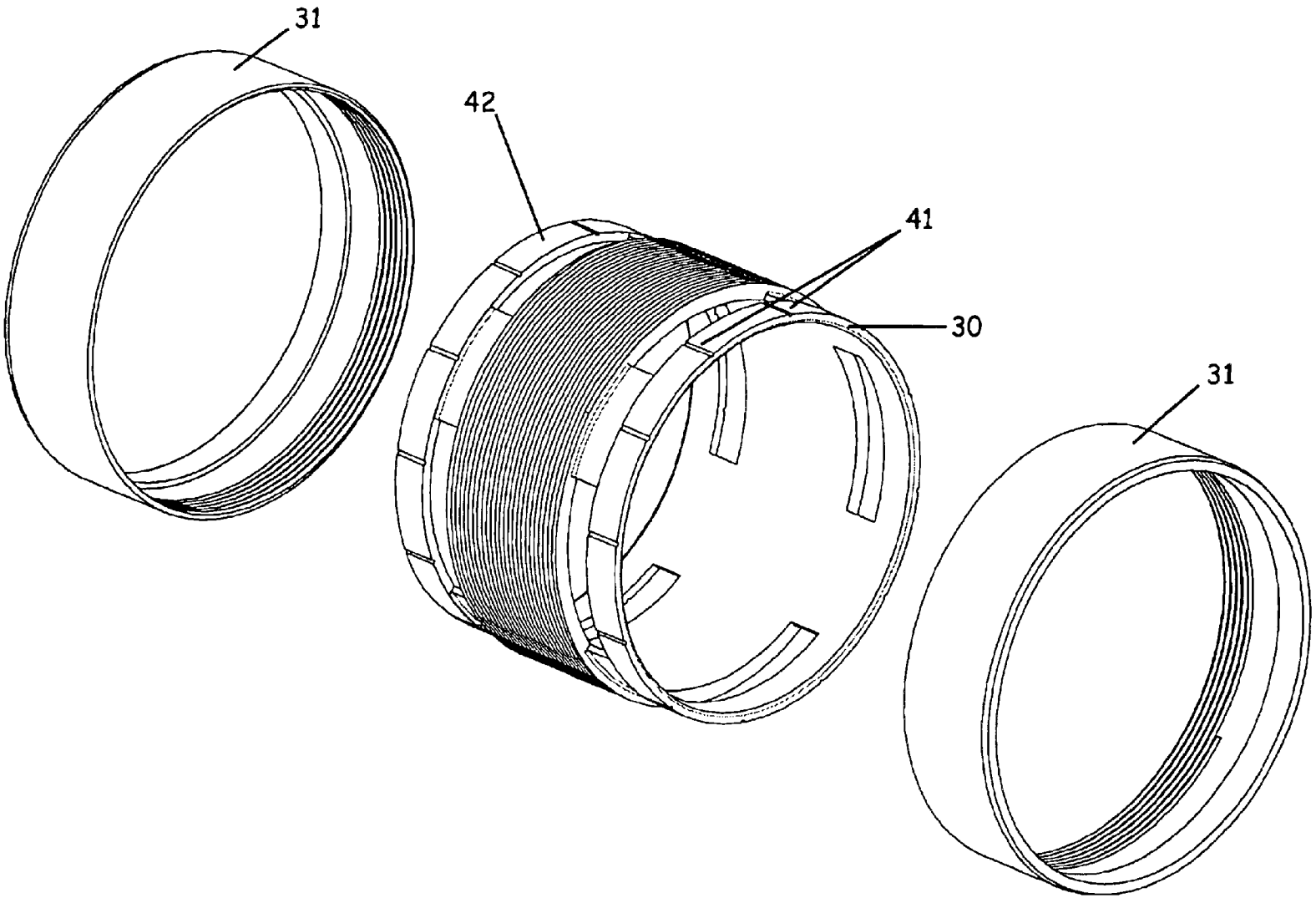
FIG. 12*a*. shows an isometric dis-assembled view of a representative water cooling ring.
Figure 12B:
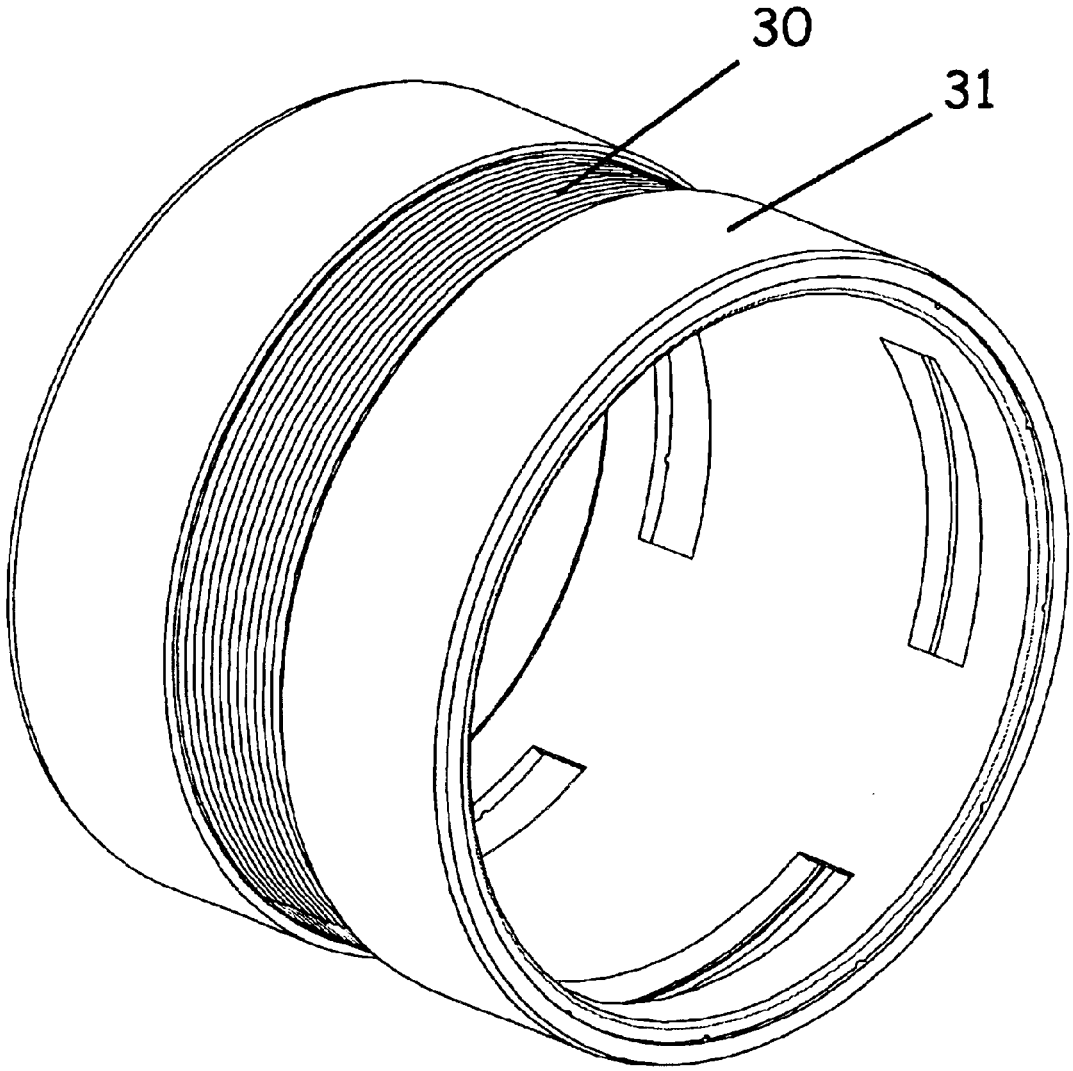
FIG. 12*b*. shows an isometric assembled view of a representative water cooling ring.

Referring to FIGS. 12*a* and 12*b*, there can be seen a particularly advantageous method of creating high velocity water streams 38 shown in FIG. 10, by machined notches or small diameter semi-circles 41 impressed onto plenum sealing collar 30. By fitting threaded outer plenum containment ring 31 to be a tight fit over the cylindrical face 42, a design is accomplished which allows for the creation of high velocity water streams 38, but with the advantage that should cleaning and maintenance of the spray nozzle be required, simply unscrewing threaded outer plenum containment ring 31 will allow access to remove any debris and water scaling deposits which might adversely effect said spray nozzle performance.

Figure 13:
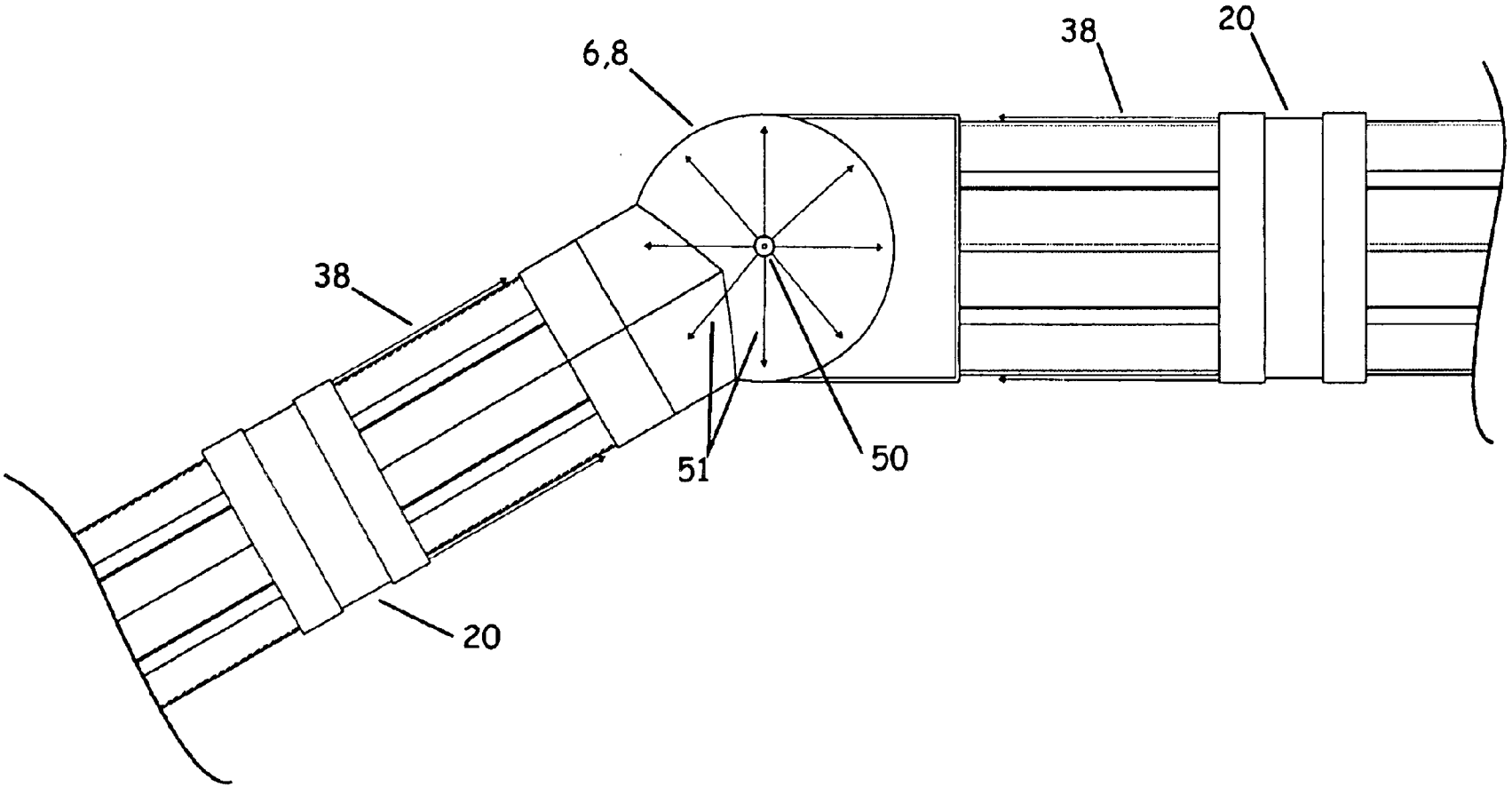
FIG. 13 shows a water cooled articulated joint of the present invention.

Referring to FIG. 13, there can be seen a cooling method for non-cylindrical components of the present invention, specifically, articulating joints 6 and 8, as represented in FIG. 1. Such joints can comprise a variety of flat and fabricated surfaces, shown as 51, which require cooling as well. Here, commercially available flat spray nozzle 50 is centrally located on flat surface 51 or the like, and provides a 360 degree flat spray essentially co-planar with surface 51 to be cooled. Also, for said joints 6 and 8, there will be additional cooling by overlap from spray nozzle rings 20 attached to the cylindrical mast and boom components 5, 7, and 9 as shown in FIG. 1.

Referring to FIG. 1, such long mast and boom lengths and the associated loads and moments they must carry, it is essential that such mast and robotic structural elements 5, 6, 7, 8, and 9 be as strong, stiff, and as lightweight as possible. Therefore, in the preferred embodiment of the present invention, it is desirable to design and construct the major structural and joint elements in carbon fibre composites, whose properties of strength, stiffness, and lightness are well known to those skilled in the art. Such properties include ultimate tensile strengths 2–3 times that of alloy steel, stiffness 2–3 times of steel, and weight one-sixth that of steel and one half that of alloy aluminum. The reference *Composites Design Guide,* published by CompositeTek, Boulder, Colo., describes the properties achievable in commercial practice. The superior performance of carbon fibre composites for large deployable robotic structures makes possible the long deployable working length required for cleaning and maintaining large combustion boilers.

Figure 2:
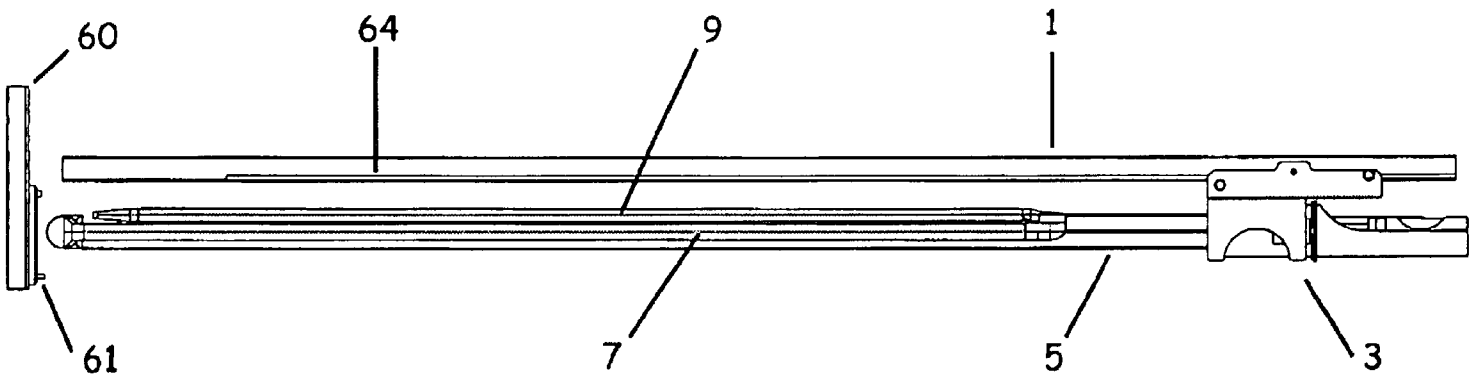
FIG. 2 shows a schematic side view of the present invention, as attached to the exterior framework of an operational fossil boiler. Omitted for clarity are the details of skin cooling apparatus.
Figure 3:
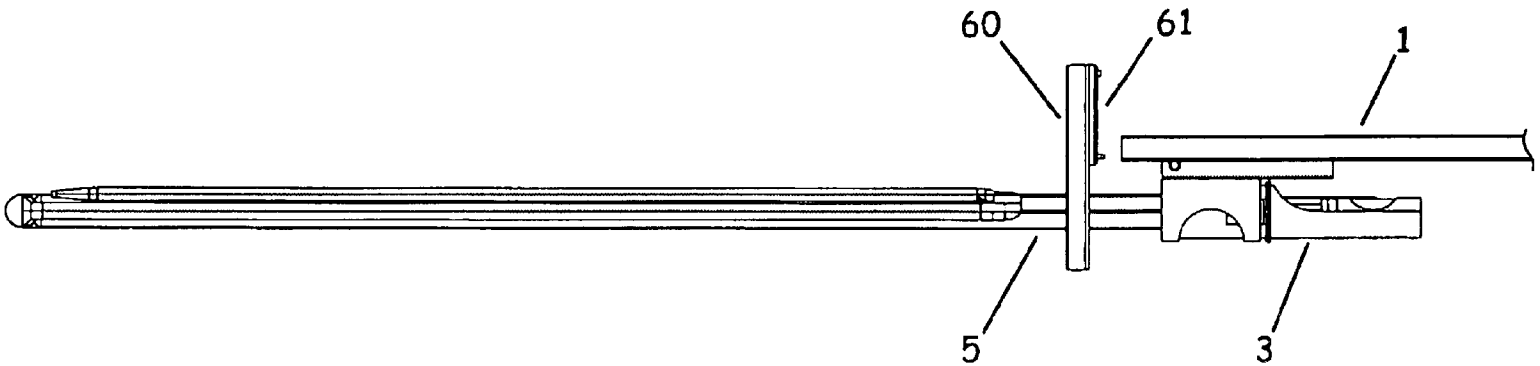
FIG. 3 is a partial cut-away view present invention, partially deployed into an operational boiler. Omitted for clarity are the details of skin cooling apparatus.
Figure 4:
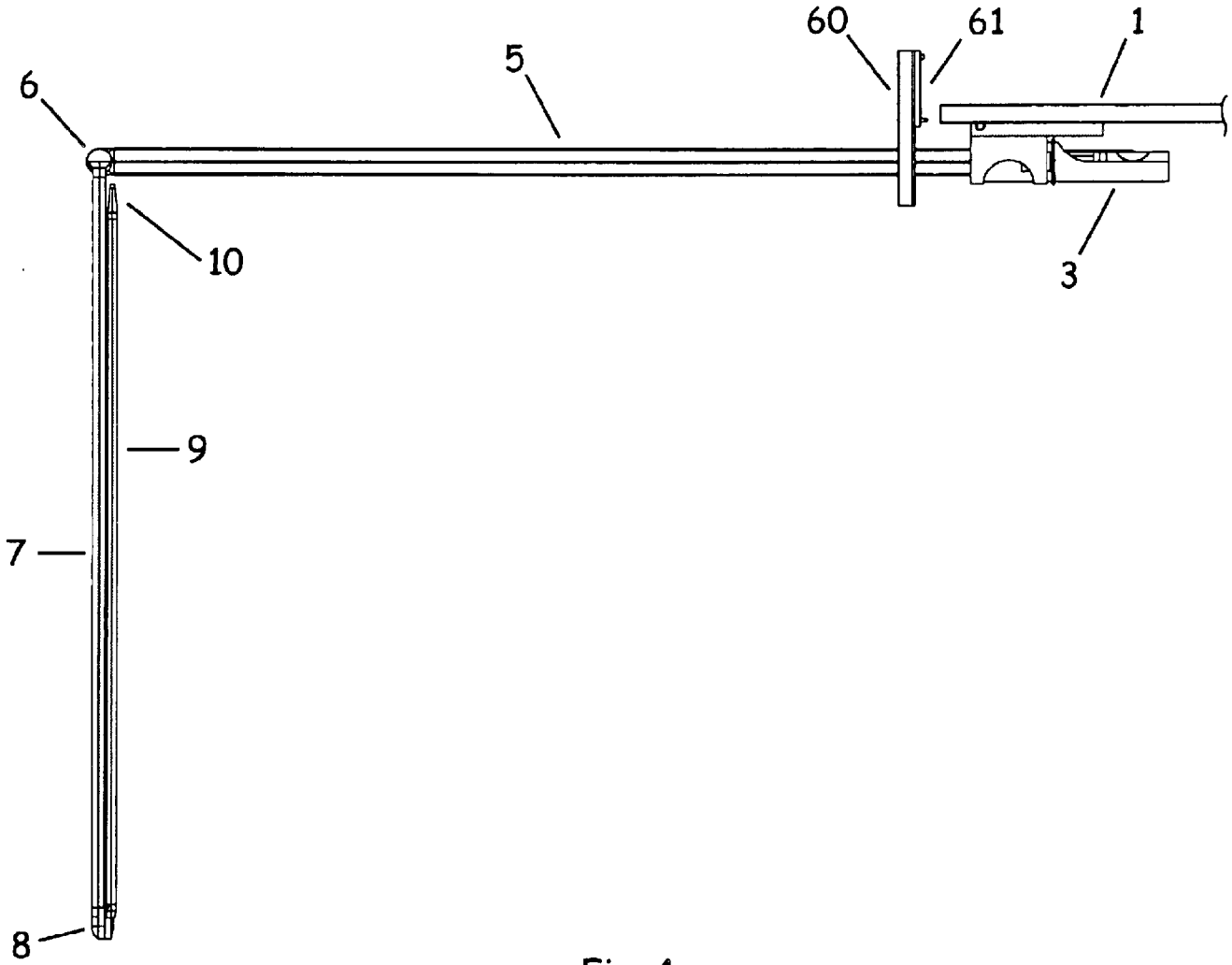
FIG. 4 shows the present invention fully deployed and partially unfolded in an operational boiler. Omitted for clarity are the details of skin cooling apparatus.
Figure 5:
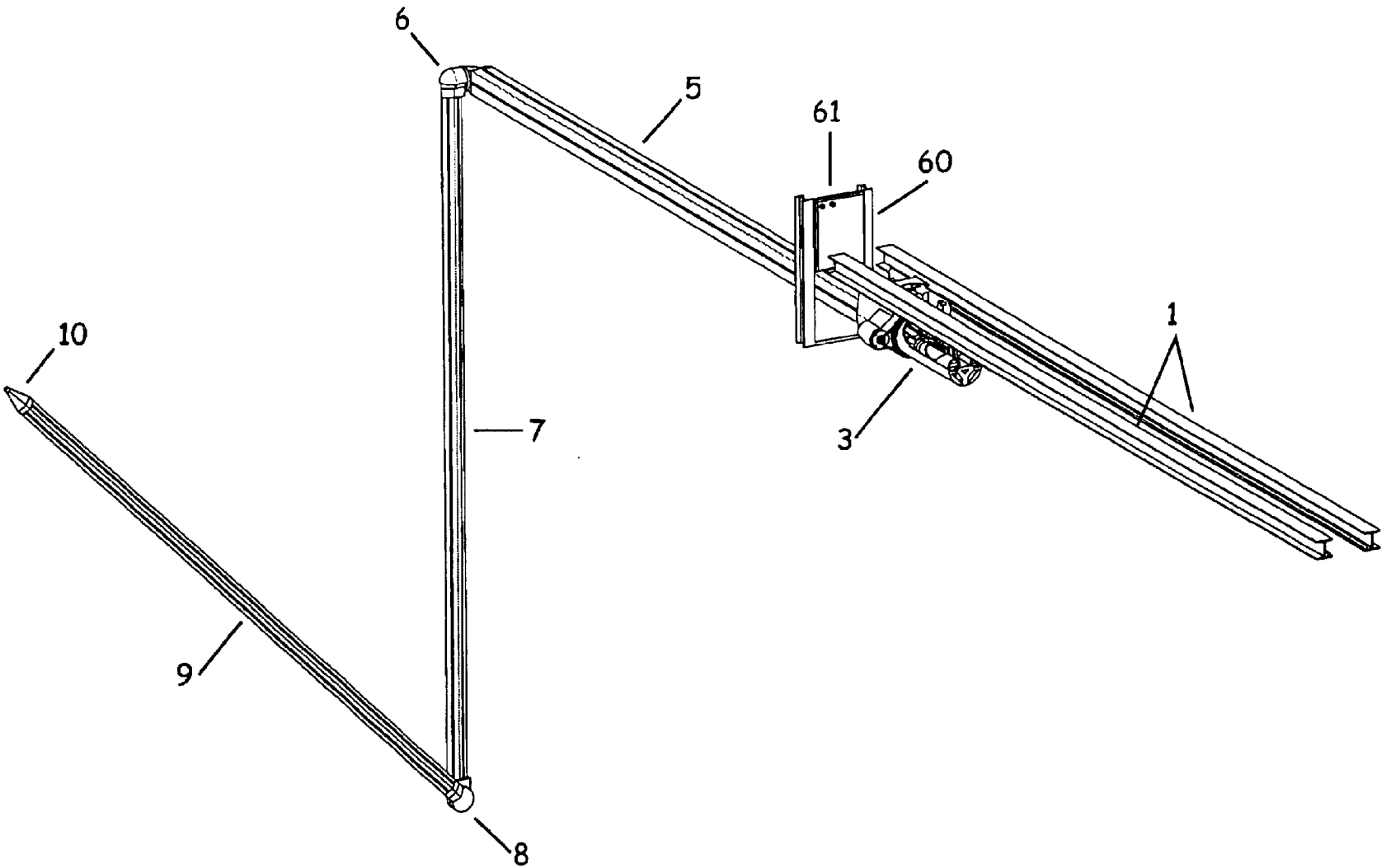
FIG. 5 shows the present invention fully deployed and unfolded inside of an operational boiler. Omitted for clarity are the details of skin cooling apparatus.

Referring to FIGS. 2, 3, 4, and 5, there is shown the sequence of insertion and deployment into the combustion boiler. FIG. 2 shows the robotic arm apparatus of the present invention stowed exterior to insulated boiler wall 60. It is mounted to a permanent or even temporary linear rail 1, which could be an existing rail previously used for an older type soot-blower mounting from manufacturers such as Diamond Power International or Clyde-Bergemann Inc. Such soot blowers are in wide spread use, and the retrofit of carriage 3 of the present invention onto an existing rail 1 would be a straightforward exercise to one skilled in the art. Even an existing geared drive rack used in the prior art could be advantageously used for carriage member 3 to drive against to facilitate the insertion and retraction of the present invention into boiler 60. Present also in FIGS. 2 and 3, is shown access door 61, which would be constructed of a size necessary to permit insertion of the present invention in its folded state, as shown. Upon retraction, the door would close, and prevent unwanted heat loss from the boiler.

Figure 6:
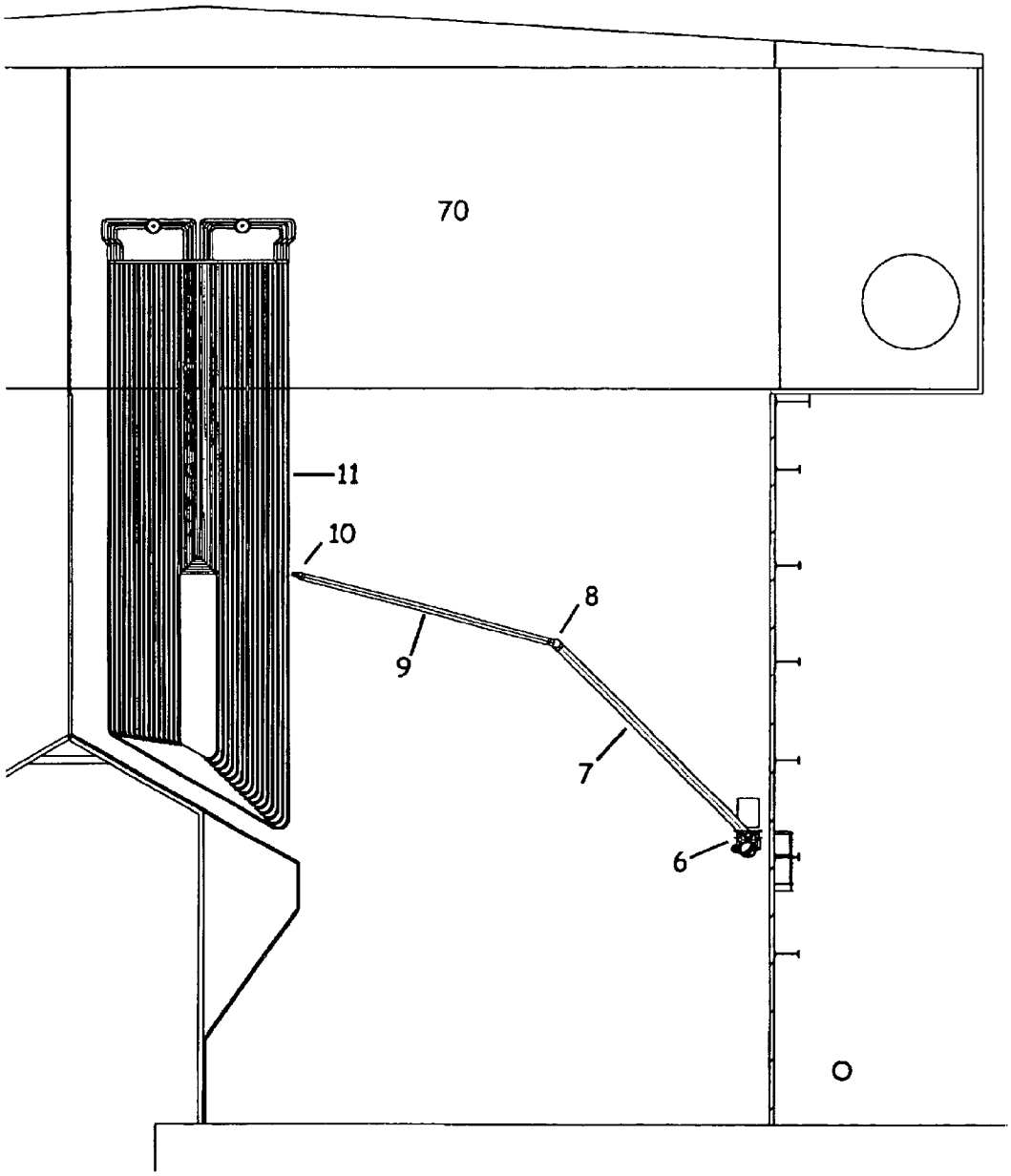
FIG. 6 shows a partially cut-away side view of a boiler, showing the range of reach of the present invention.
Figure 7:
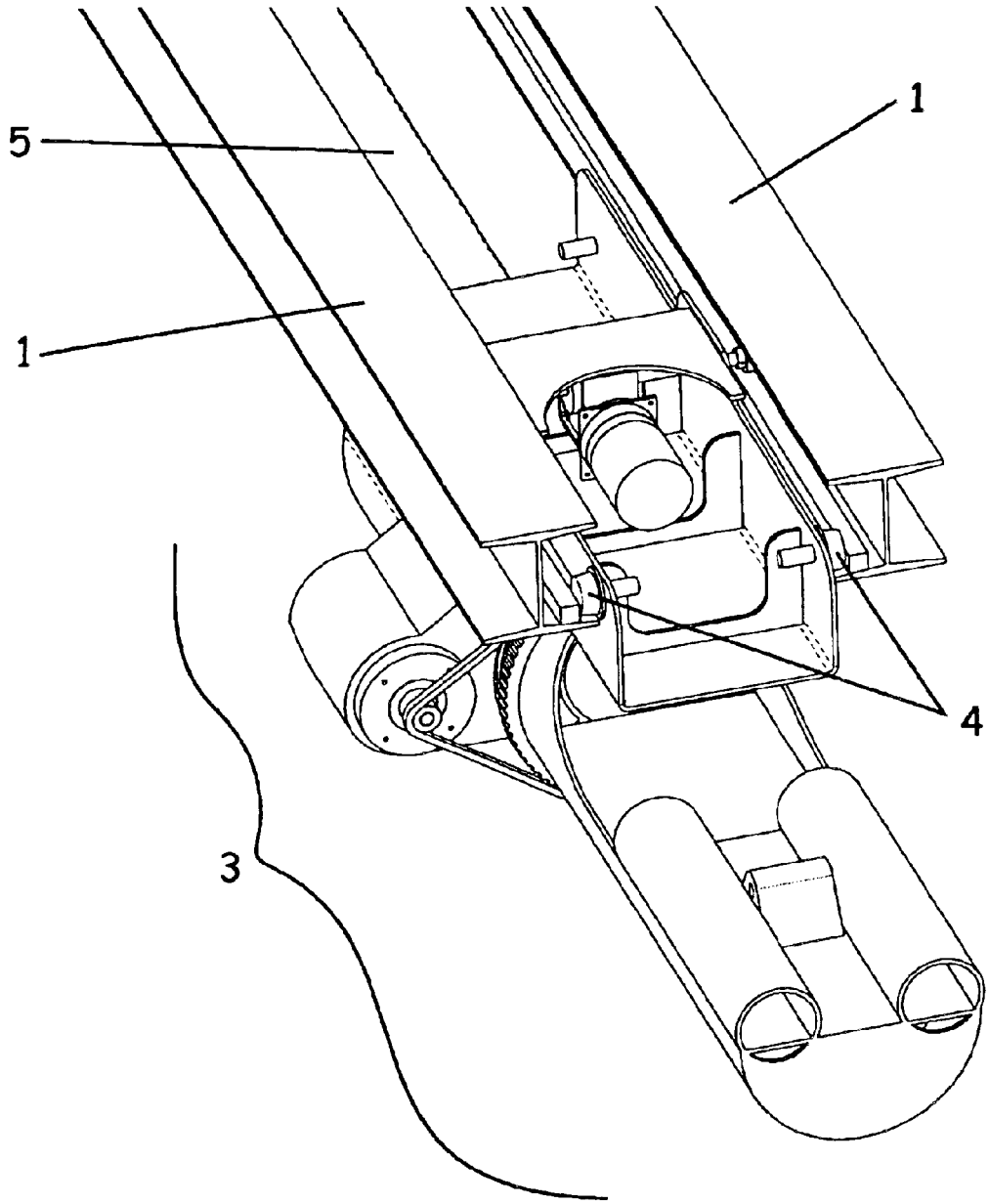
FIG. 7 shows a partial cut-away of the traverse carriage mechanism of the present invention.
Figure 8:
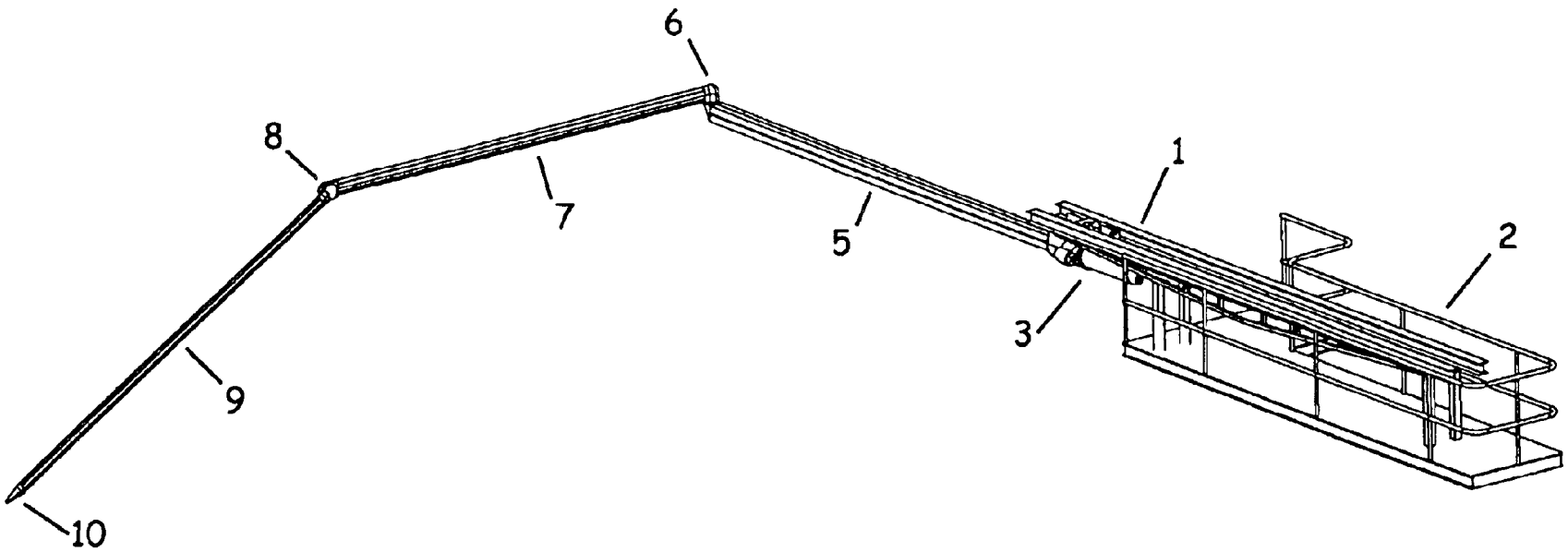
FIG. 8 shows an isometric perspective of the present invention as mounted on a skid deck.
Figure 9:
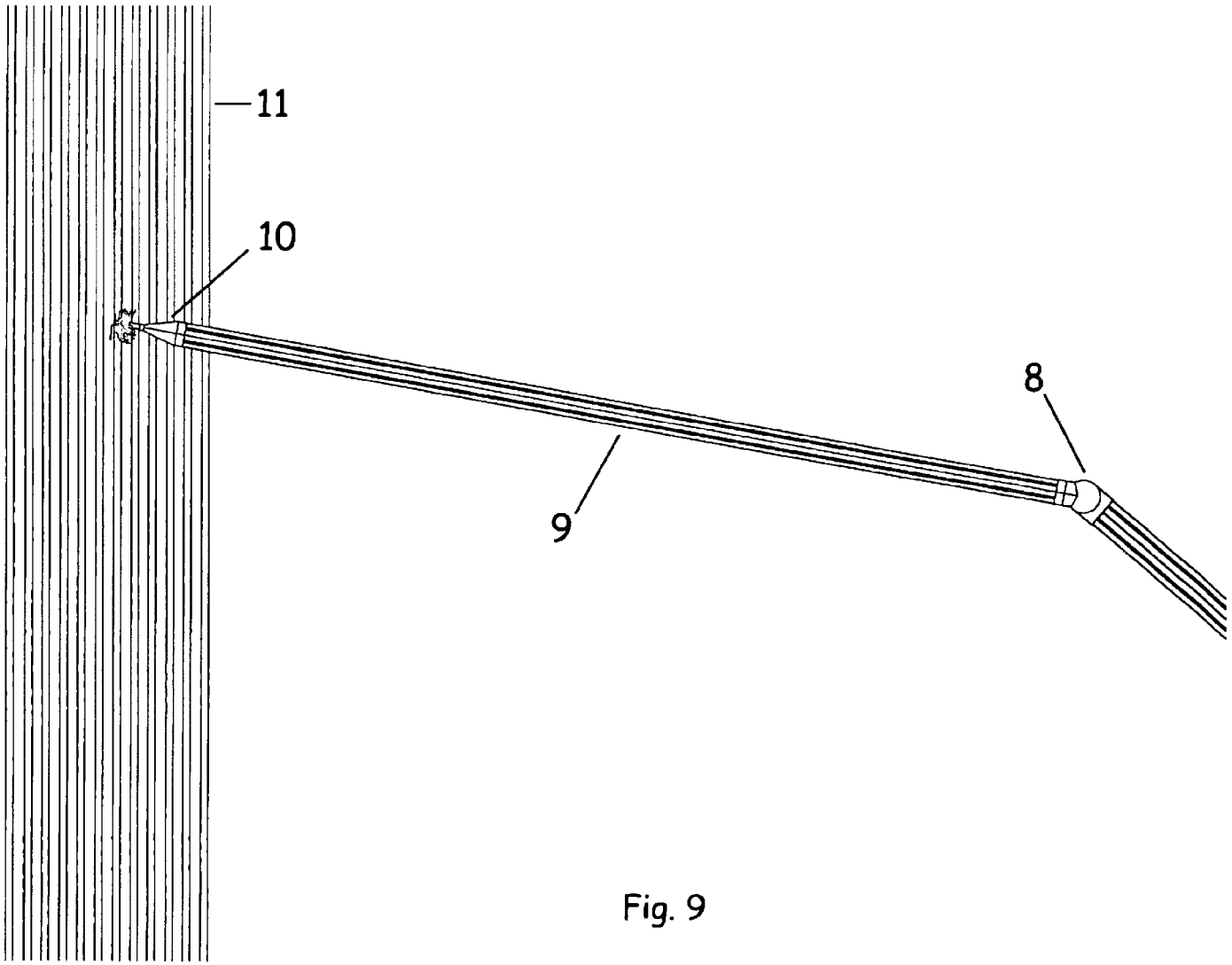
FIG. 9. shows a water lance cleaning apparatus of the present invention.

Referring to FIG. 6, there is shown the present invention deployed into a boiler typical of the type found in the electric power utility industry in the U.S. Heat transfer pendant 11, being comprised of many bent and fabricated high alloy steel tubes, typically hangs or is supported from the roof 70 of the boiler. Heat transfer pendant 11 can have the exposed dimensions of 60 feet high, and 12–10 feet wide, and typically can be spaced apart from 9 inched to 48 inches center-to-center. These structures are also referred to as superheater or reheater pendants, and form the basis for much of the heat transfer from the combustion gasses into superheated steam contained within the heat transfer pipes. It can be seen that the present invention water lance tip 10 can access much of the exposed pendant heat transfer surface 11, by manipulating the angles of joints 8 and 6, and rotation of mast 5, and that by moving the carriage 3 with respect to fixed rail 1 of FIG. 1, the many spaced and stacked superheater or reheater pendants can be likewise accessed equally well.

It is well known in the industry that thermally quenching still hot slag deposits located on heat transfer tubes will crack the slag and cause it to fall away from the heat transfer surfaces. The present invention is particularly novel, in that it allows the positioning of a small diameter, low flow, and low pressure water stream directly impingent on a slag deposit of interest. This is made possible by the unique ability of the present invention to precisely position itself within a few inches of a desired surface, as shown in FIGS. 1 and 10. Tip 10 is shown to be plumbed with a low pressure, low flow water source which is supplied from outside the boiler through a flexible or rigid tube, to be directed at tip 10 as desired. It has been proven that such a combination of low pressure water, between 35 to 200 PSI, and low flow rate water, between 2 and 20 gallons per minute, does not cause damage to the underlying alloy steel heat transfer tubes, and only causes the desired slag to be quenched and removed. This is in direct contrast to the water cannons presently employed in the art, which required 10,000 PSI and 150 gallons per minute to be effective. Such water canons are required to be mounted external to the combustion zone, and must direct a high pressure stream across 40–80 feet inside of the combustion chamber to be effective. Manufacturers of such devices are Diamond Power International and Clyde-Bergemann, Inc.

Referring to FIGS. 14–18, a control system has been designed for the present invention robot arm. The design process included the following steps:

1. Development of a model for the dynamics of the robot arm and to implement in a mathematical tool like Matlab Simulink.

2. Linearization of the model about a selected operating point and obtain the state space representation of the model.

3. Development of sample linear quadratic regulators to control the position of the end of the robot arm.

Figure 14:
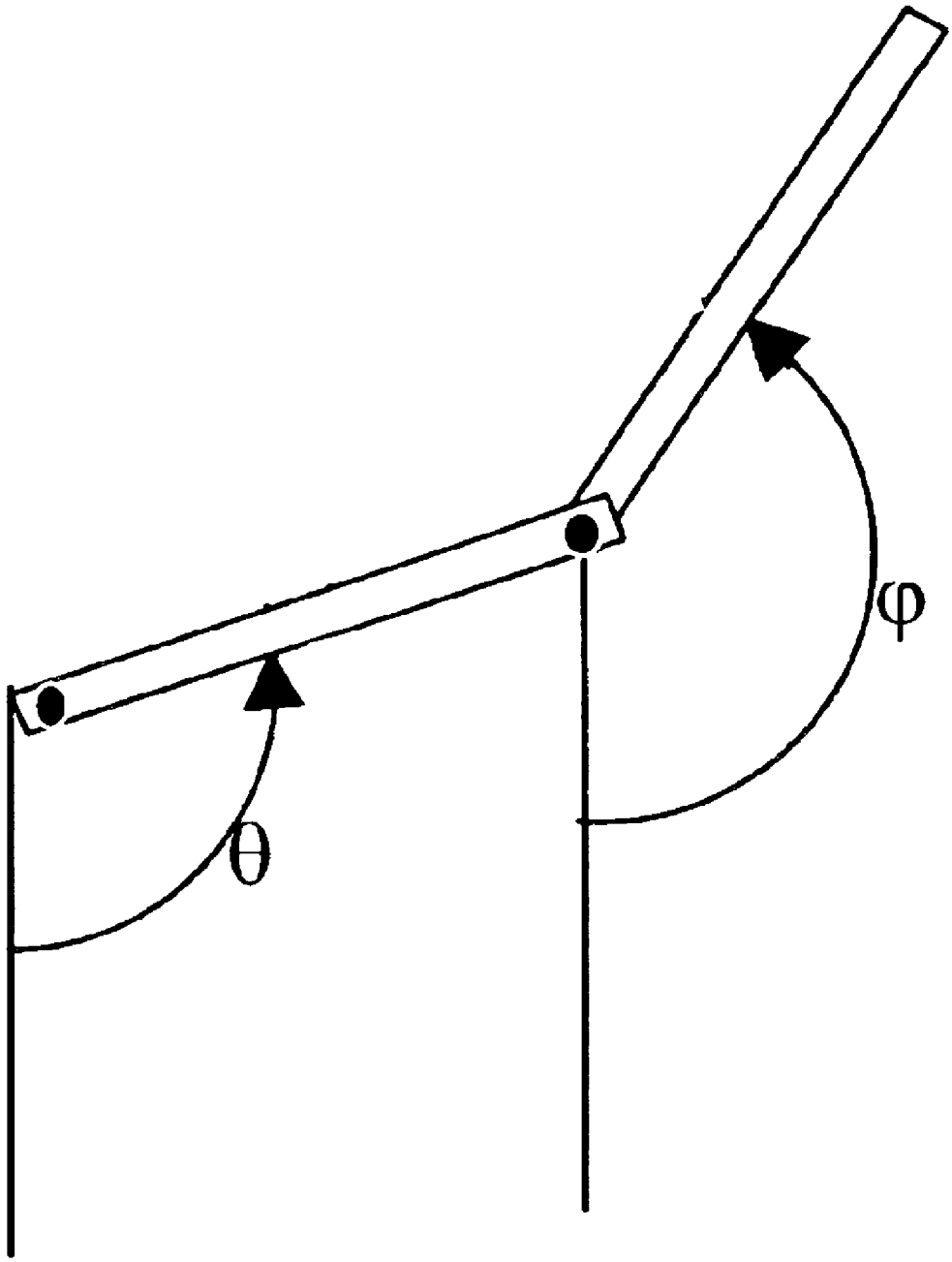
FIG. 14 shows an idealized inverted pendulum linkage representation of the present invention.

Referring to FIG. 14, the six states used in the model are $\theta$, $\Phi$, $\dot{\theta}$, $\dot{\Phi}$, the integral of $\theta$, and the integral of $\Phi$ (a dot above the variable signifies its derivative). The dynamics of the robot arm can be determined from the following torque balance equations:

$$\text{Let } \theta'=\theta+\pi/2 \text{ and } \Phi'=\Phi+\pi/2$$

Subscripts 1 and 2 signify properties of the inner link (bicept) and outer link (forearm) respectively. The torque T, applied at the joints is:

$$T_1=a\cos\theta'+b\cos\Phi'+\dot{\theta}'[c+d+e\cos(\Phi'-\theta')]+\dot{\Phi}'[f+e\cos(\Phi'-\theta')]-\dot{\Phi}'^2 e\sin(\Phi'-\theta')+\dot{\theta}'^2 h\sin(\Phi'-\theta')$$

$$T_2=b\cos\Phi'+\dot{\theta}'e\cos(\Phi'-\theta')+\dot{\Phi}'f-\theta'^2\sin(\Phi'-\theta')$$

Where:

$$a=\left[\frac{m_1}{2}+m_2\right]gL_1$$

$$b=\frac{m_2 g L_2}{2}$$

$$c=\frac{m_1 L_1^2}{3}$$

$$d=m_2 L_1^2$$

$$e=\frac{m_2 L_1 L_2}{2}$$

$$f=\frac{m_2 L_2^2}{3}$$

$$h=\frac{L_1 L_2}{2}$$

L s denote the arm lengths, m s the arm masses and g is the gravatational constant.

The state space representation of the linearized system is:

$$\dot{X}=AX+Bu$$

$$Y=CX+Du$$

We define X, the state vector for our system as:

$$X_1=\theta'$$

$$X_2=\Phi'$$

$$X_3=\dot{\theta}'$$

$$X_4=\dot{\Phi}'$$

$$X_5=\int\theta'$$

$$X_6=\int\Phi'$$

u is the inputs to the system, in this case the two torques applied at the arm joints. For full state feedback control u=−kX, where k is the feedback gain matrix.

Figure 15:
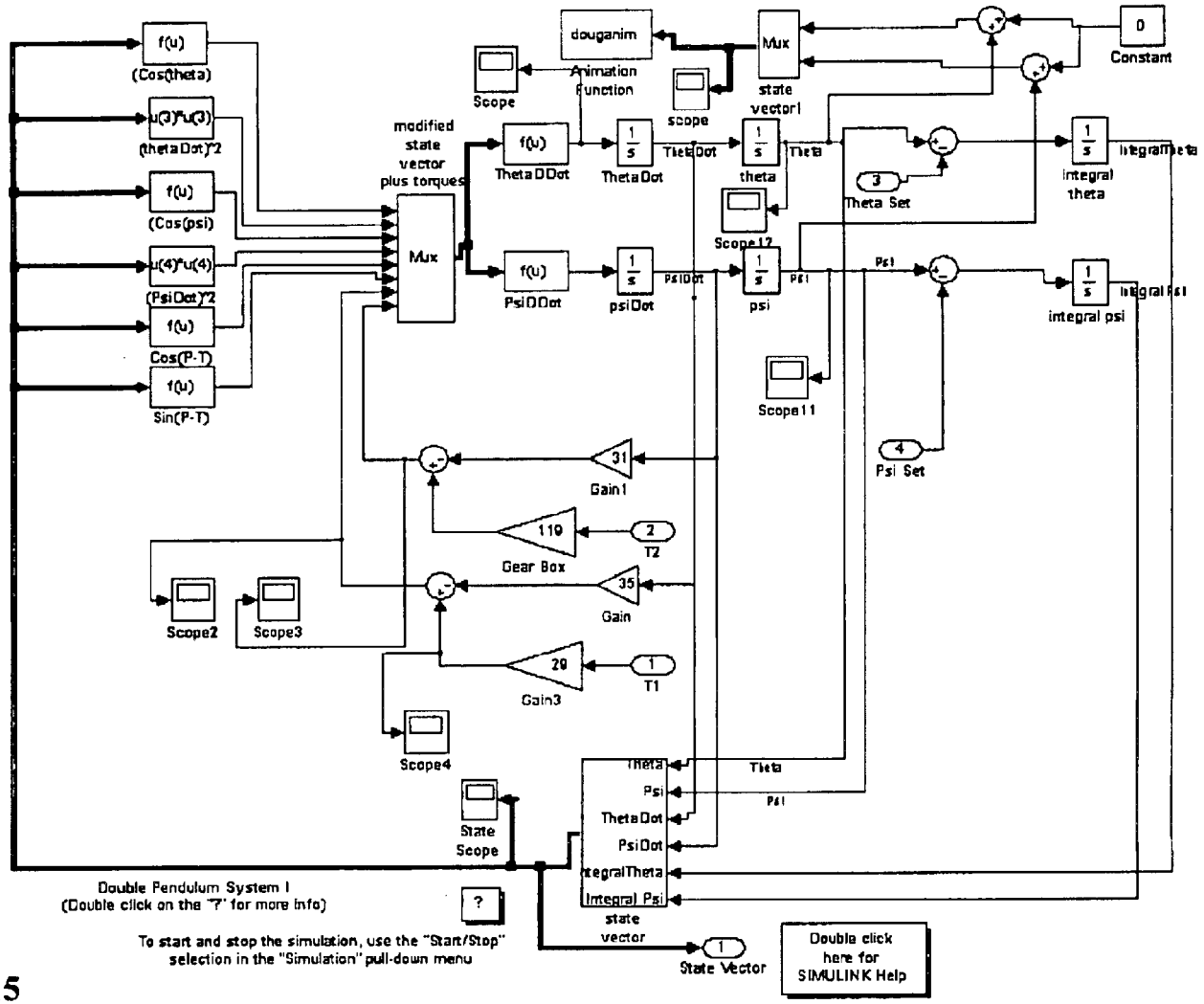
FIG. 15 shows an idealized mathematical control system of the present invention.

From the state space equations it is needed to solve the torque equations for $\dot{\theta}$+ee ' and $\dot{\Phi}$+ee '. This was done and the resulting state space formulation for the open loop plant was implemented in a Simulink modeling subsystem. This subsystem, called PLANT, is shown in FIG. 15

This Simulink diagram was used with the Matlab linmod command which linearizes the plant about particular values of $\theta$ and $\Phi$ and computes the A, B, C, and D matrices. Next the Matlab LQR function was used. LQR provides a linear-quadratic regulator design for continuous-time systems as follows.

$[k,S,E]=LQR(A,B,Q,R)$ calculates the optimal gain matrix $k$ such that the state-feedback law $u=-kX$ minimizes the cost function $$J=\int\{X'QX+u'Ru\}dt$$

subject to the state dynamics X=AX+Bu.

"Optimal" is a deceptive term since the design engineer selects the Q and R matrices more or less arbitrarily. The Q matrix penalizes persistent error in the state variables while the R matrix penalizes persistent or excessive force (torque in our case). The Q and R matrix were manipulated to explore various design alternatives. Each was evaluated by viewing an animation of the robot arm responding to step changes in position and by examining the torques required to produce the response. Exploring alternatives always aids in gaining intuition. For example, it is clear that the Q and R matrices are not strictly independent. If elements of the Q matrix penalize non-zero angular velocities, then excessive torques will not be applied, even if they are not penalized by the R matrix.

Figure 16:
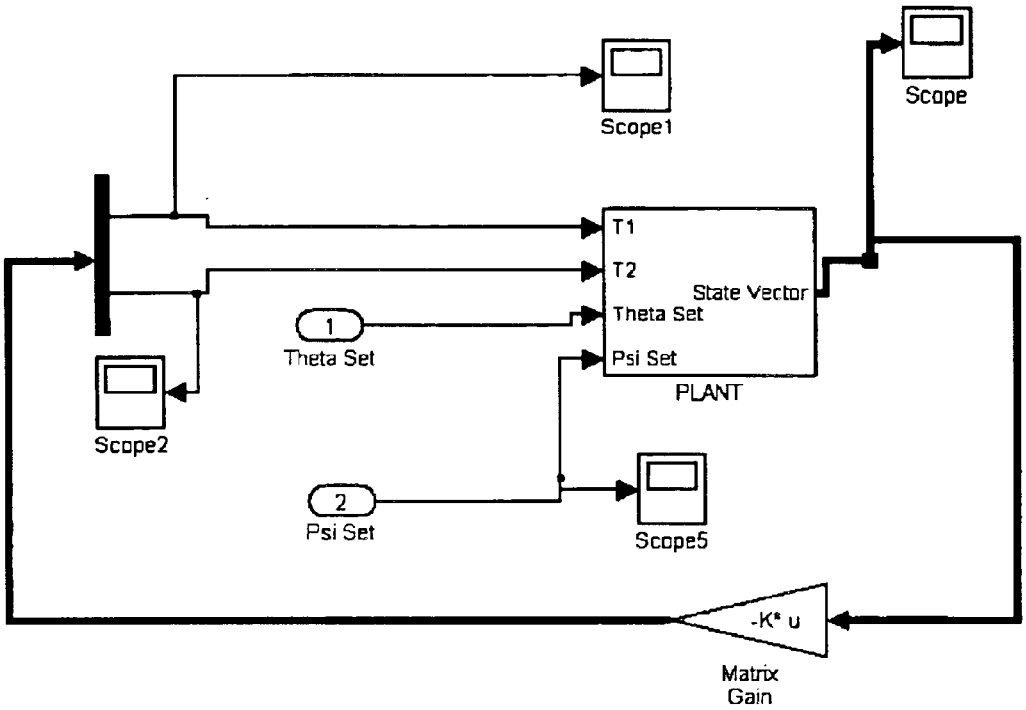
FIG. 16 shows an idealized mathematical feedback and set-points of the control system of the present invention.
Figure 17:
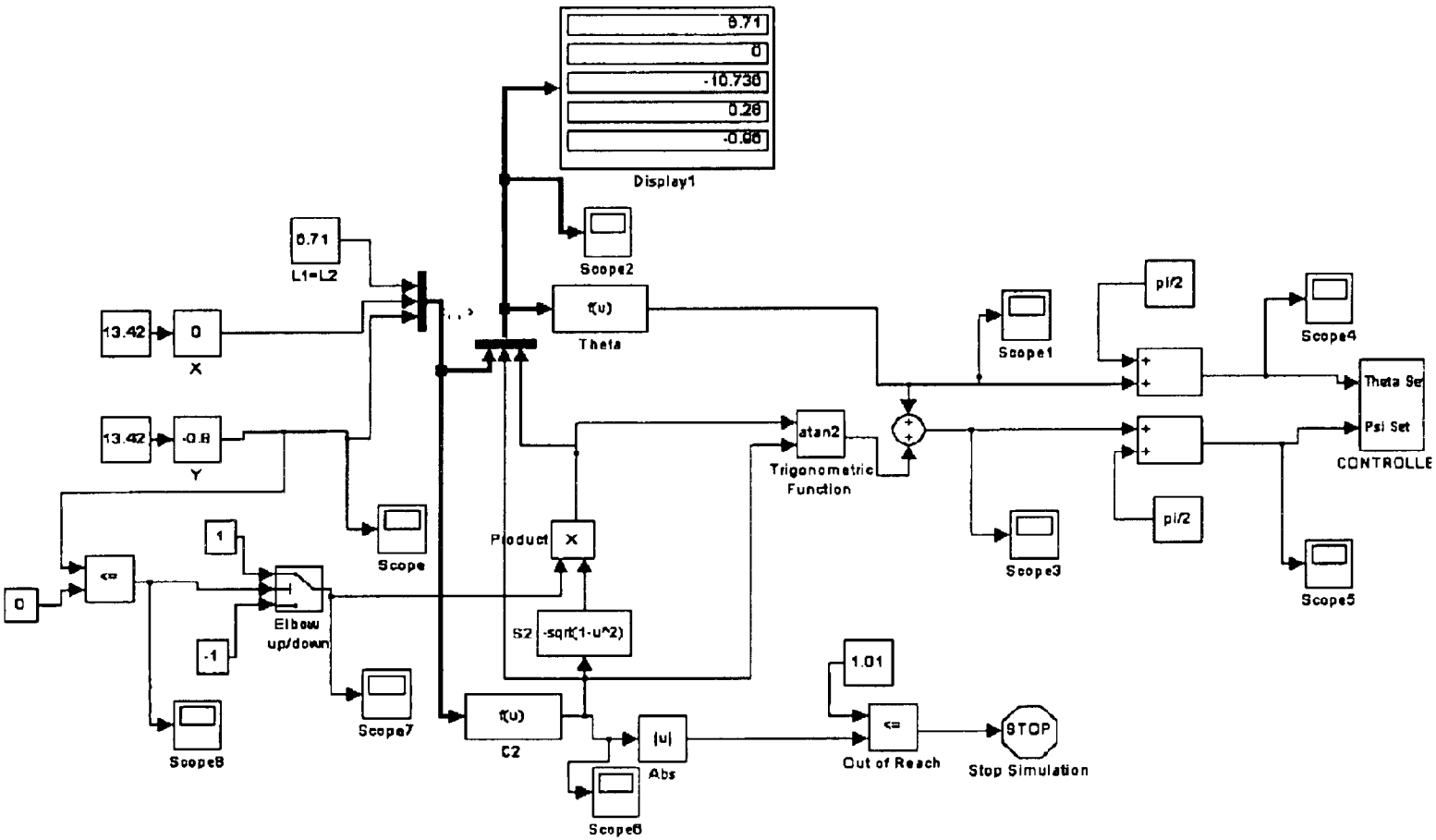
FIG. 17 shows an in greater detail the plant function block of FIG. 16.

FIG. 16 shows the CONTROLLER subsystem that computes the torques to be applied to the joint motors according to the state feedback equation described above. Please note that the feedback gain matrix is multiplied by the state vector (u=−kX). The gain block shown in the figure shows "−ku." This is a Simulink convention that labels inputs to all blocks with the variable name u.

The controller is designed to stabilize the robot arm at any specified angles $\theta$ and $\Phi$. However, an operator may wish to position the end of the arm at specific x and y Cartesian coordinates. The top level of the Simulink model transforms the x, y user supplied coordinates to their respective joint angles. This is shown in FIG. 16. Moreover, there is a movement constraint on the robot arm caused by a wall to the left of the primary arm axis, making negative x coordinates forbidden. $\theta$ and $\Phi$ are computed so that the "elbow" is up or down so as to avoid violating this constraint.

Figure 18A:
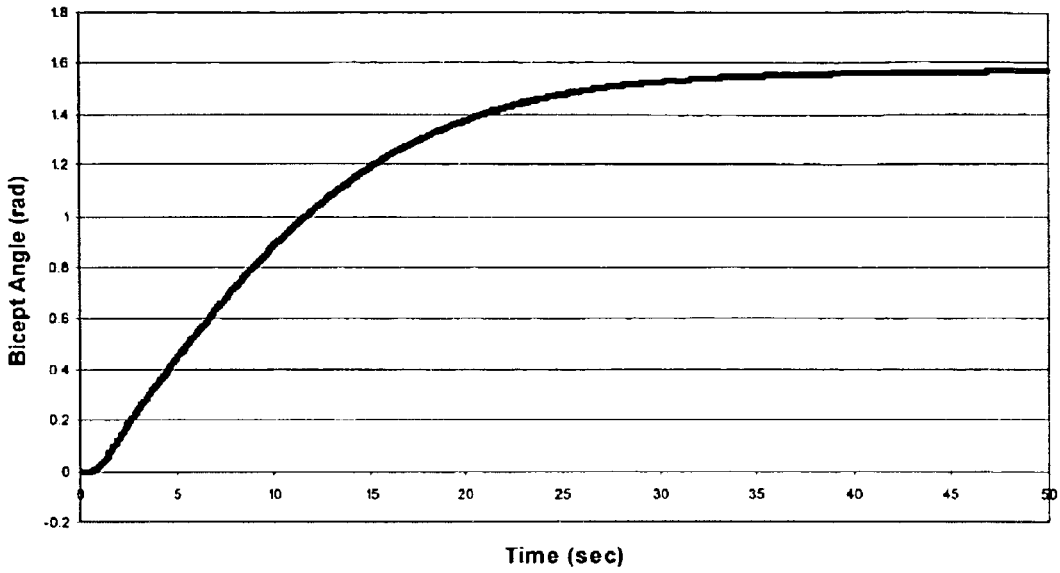
FIGS. 18*a-h* shows the physical system response of the present invention to un-optimized and optimized control state space variable matrix coefficients.
Figure 18B:
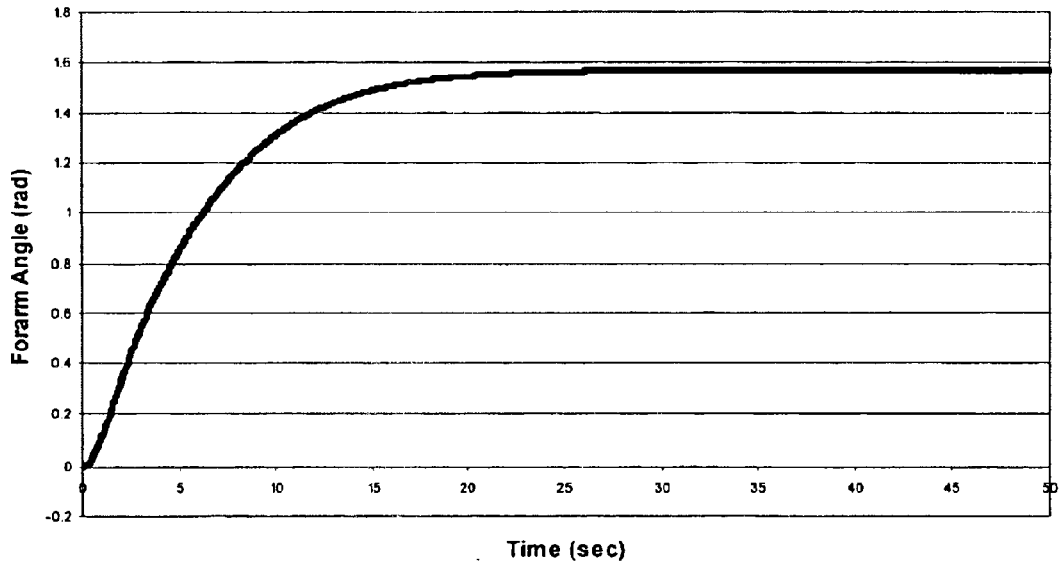
Figure 18C:
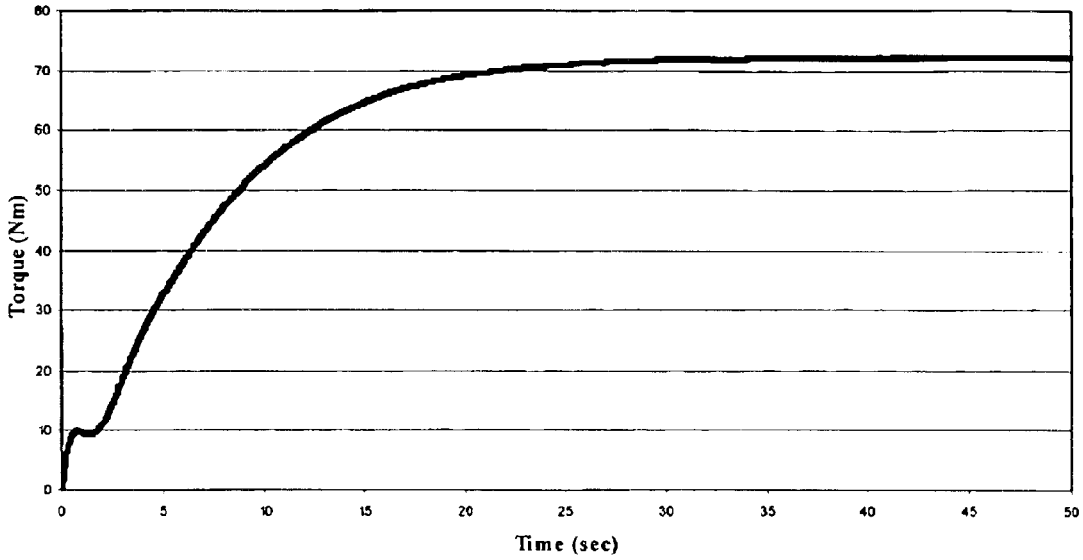
Figure 18D:
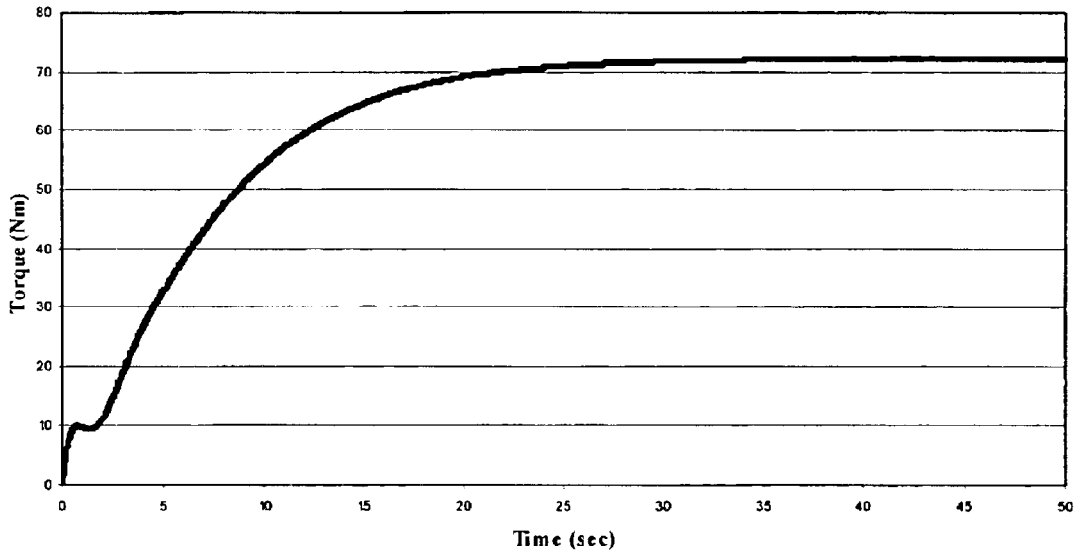

FIGS. 18*a*–*h* shows the response of a sample design based on the geometry of the present invention. FIG. 18*a* shows the change in bicep angle vs. time as comparatively slow but well damped. FIG. 18*b* is the same for the forearm, but showing significantly faster motion without requiring torques that are much larger than the static torque required to hold the arms in a horizontal position. The angle and torque graphs reflect a step change in position from hanging at bottom dead center (no torque) to both arms at horizontal (maximum steady state torque). FIGS. 18*c* and 18*d* shows the mast torque and elbow torque vs time.

The unoptimized design moves 90 degrees in about 20 to 30 seconds. It never exceeds the required static torque and might be in keeping with the speed of an operator controlling the x, y values with a joystick. The gain matrix is shown below.

$$k_S = \begin{bmatrix} 142.0 & 20.3 & 104.6 & 30.6 & 21.9 & -4.4 \\ 3.5 & 11.4 & 6.4 & 6.6 & 0.44 & 2.2 \end{bmatrix}$$

Faster response is also achievable without excessive torque as shown by a design optimization as shown in FIGS. 18*e–h*. Note the change in time scale.

The gain matrix for the optimized design is:

$$k_f = \begin{bmatrix} 1185 & 440 & 741 & 270 & 666 & 236 \\ -406 & 1156 & -231 & 669 & -236 & 666 \end{bmatrix}$$

This faster design goes from bottom dead center to horizontal in about 5 seconds and still uses little more than the static torque required at each joint.

Figure 18E:
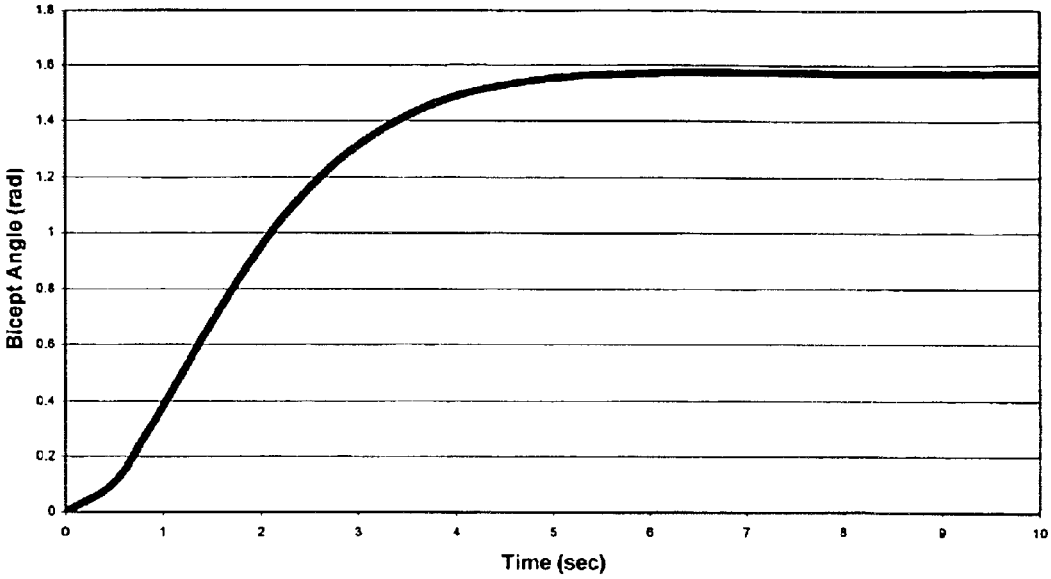
Figure 18F:
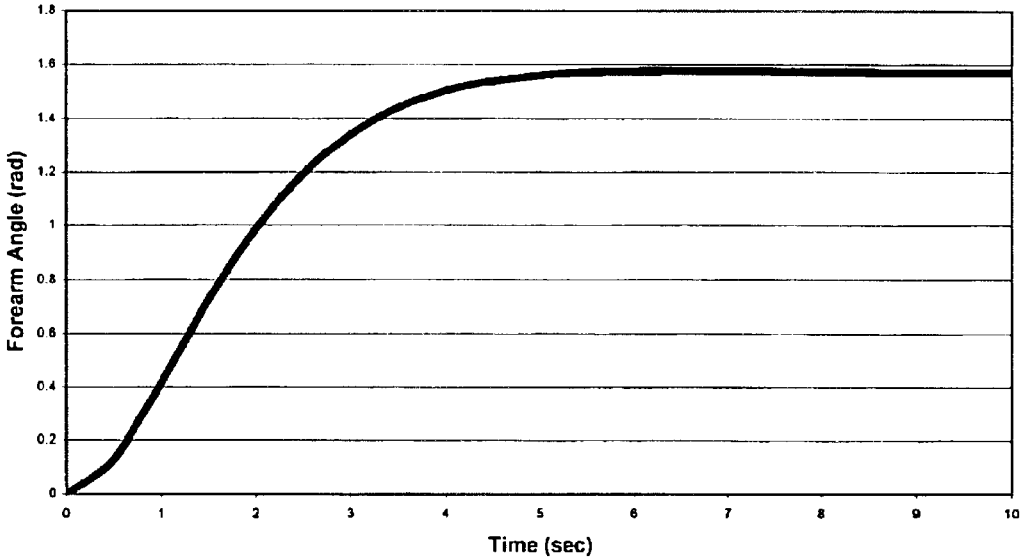
Figure 18G:
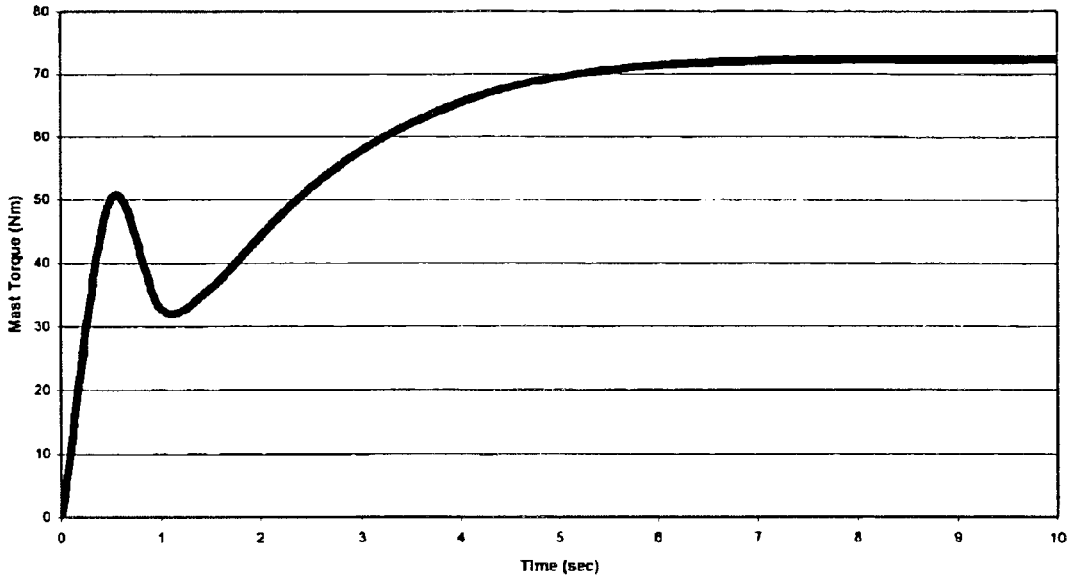
Figure 18H:
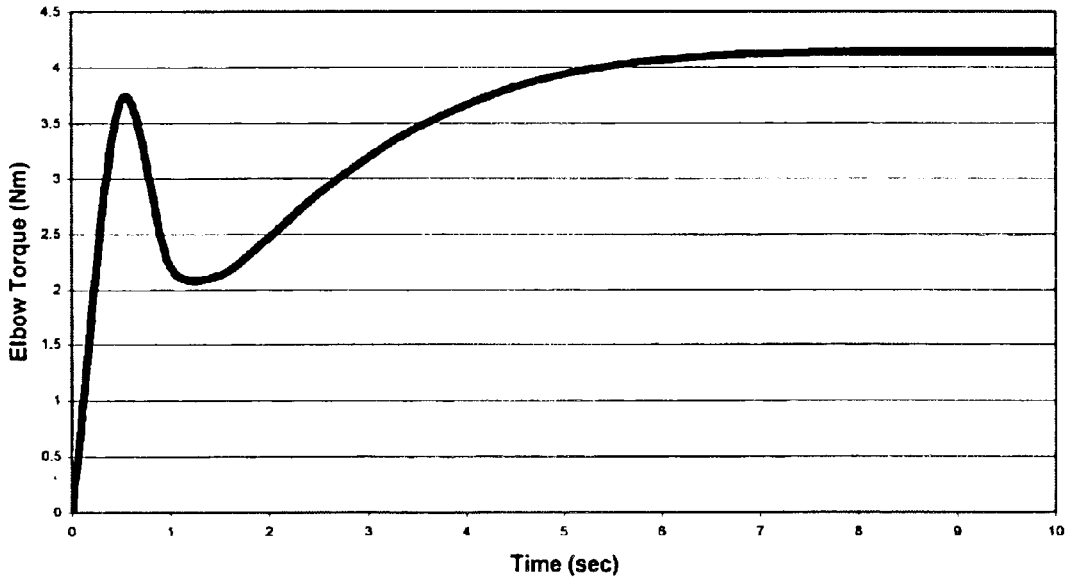

FIGS. 18*e* and 18*f* show the bicep and elbow angle vs time for the case of a highly optimized controller matrix coefficients, showing that a 10 improvement in response time is achievable with optimization. FIGS. 18*g* and 18*h* show the corresponding mast and elbow torques needed to provide for the optimized fast motion profiles of FIGS. 18*e* and 18*f*, respectively.

Thus, the state space controller methodology to control the position of the end of the arm of the present invention is preferred for the present invention, although other less advanced methods will yield acceptable performance in a preferred embodiment.

Positioning of the present invention can be accomplished by either fully automated computer controls, or using a joystick. One well known method is to slew the x and y coordinates at a rate proportional to joy stick position. If the joystick is centered, the x and y coordinates should be frozen at their current value.

It can be easily determined by one skilled in the art, that the positional and environmental tolerance of the present invention lends itself to a variety of other boiler maintenance applications. These include, but are not limited to boiler inspection, boiler welding, boiler metal cutting, as well as lifting, positioning, etc. Such activities are easily accomplished by adding additional capability to the end tip 10 of the present invention. For inspection activities, it is trivial to add a video imaging camera system to be mounted within any of the cooled structures. Such a system would display close-up imagery to either an external monitor, computer display, or other imaging or printing device. For welding and maintenance activities, it is possible to add a commercially available remote welding head to the tip position 10, so as to be able to commence welding immediately after boiler shut-down, even while the internal surfaces are over 1000 degrees Fahrenheit in temperature. For metal cutting and removal activities, it is possible to add an end effector which cuts or grinds metal while under remote control.

Thus, there has been presented an invention which allows for cleaning and maintenance of a combustion fired boiler. Such an invention is not limited to any particular design or type or construction of a boiler. Having described my invention, many modifications will become apparent to those skilled in the art to which it pertains without deviation from the spirit of the invention as defined by the scope of the appended claims.

I claim:

1. A robotic apparatus for the cleaning and maintenance of a boiler comprising:

at least two rigid structural members joined by at least one remote controlled articulated jointed member a carriage member carrying the above two structural members and translatably mounted external to said boiler to allow insertion and retraction of said structural and joint members into said boiler, at least one cooling system providing an essentially circumferentially continuous annular water spray surrounding an interior structural member.

2. The apparatus of claim 1 further comprising a water delivery member for application of a water stream in close proximity to a boiler slag deposit.

3. The apparatus of claim 1 whereby a welding device is attached to one of the structural members.

4. The apparatus of claim 1 wherein a metal cutting device or grinding device is attached to one of the structural members.

5. The apparatus of claim 1 wherein an electronic imaging device or devices is attached to one of the structural members.

6. The apparatus of claim 1 wherein at least one member of the apparatus can be inserted into and retracted out-of an operational combustion boiler.

7. The apparatus of claim 1, further comprising a water delivery member for application of a water stream within three inches of a boiler slag deposit.

8. A robotic apparatus for the cleaning and maintenance of a boiler comprising:

at least two rigid structural members joined by at least one controlled articulated jointed member a carriage member carrying the above two structural members and translatably mounted external to said boiler to allow insertion and retraction of said structural and joint members into said boiler;

wherein control signals applied to cuase motion thereof are generated from an optimal state-space control algorithm.

9. The apparatus of claim 8 wherein an electronic device or devices is attached to one of the structural members.

10. A boiler cleaning apparatus, comprising:

a first structural member;

a second structural member rotatably connected to the first structural member by a first controlled motor-driven joint;

a carriage supporting the first and second structural members translatably mounted to the boiler, a fluid supply running through an annulus of the first and second structural members.

11. The boiler cleaning apparatus of claim 10, wherein the controlled motor-driven joint is a remote-controlled hinge.

12. The boiler cleaning apparatus of claim 10, wherein the carriage is translatably mounted to a linear rail external of the boiler.

13. The boiler cleaning apparatus of claim 10, wherein at least one of the first and second structural members can be inserted into and retracted out of an operational coal fired boiler.

14. The boiler cleaning apparatus of claim 10, further comprising an electronic imaging device attached to one of the first and second structural members.

15. The boiler cleaning apparatus of claim 10, further comprising a remotely controlled end effector attached to a tip of one of the first and second structural members.

16. A boiler cleaning apparatus, comprising:

a first structural member;

a second structural member rotatably connected to the first structural member by a first controlled motor-driven joint;

a carriage supporting the first and second structural members translatably mounted to the boiler;

a third structural member rotatably connected to one of the first or second structural members by a second controlled motor-driven joint;

a cooling system for the first and second motor-driven joints;

wherein the first controlled motor-driven joint is rotational according to a first degree of freedom, and the second controlled motor-driven joint is rotational according to a second degree of freedom;

wherein the first and second degrees of freedom are orthogonal with respect to one another.

17. A boiler cleaning apparatus, comprising:

a first structural member;

a second structural member rotatably connected to the first structural member by a first controlled motor-driven joint;

a carriage supporting the first and second structural members translatably mounted to the boiler;

a third structural member rotatably connected to one of the first or second structural members by a second controlled motor-driven joint;

a cooling system for the first and second motor-driven joints;

wherein the first and second controlled motor-driven joints are controlled by signals generated by an optimal state- space control algorithm.

18. A method of removing slag deposits, comprising:

providing a robotic arm;

inserting the robotic arm into a boiler;

remotely positioning a tip of the robotic arm adjacent to a slag deposit according to three degrees of freedom;

flowing low pressure, low flow rate water from the tip of the robotic arm to the slag deposit.

19. The apparatus of claim 18, wherein the low pressure comprises less than 200 PSI, and the low flow rate comprises less than 20 gallons per minute.

20. The method of claim 18, wherein the flowing water comprises directly impinging the slag deposit with water from the tip.

21. The method of claim 18, wherein the positioning comprises moving the tip of the robotic arm within three inches of the slag deposit.

22. A method, comprising:

removing a slagdeposit from a boiler while the boiler is in operation, the method further comprising:

providing a robotic arm;

inserting the robotic arm into a boiler;

remotely positioning a tip of the robotic arm adjacent to a slag deposit according to three degrees of freedom;

flowing low pressure, low flow rate water from the tip of the robotic arm to the slag deposit.

23. A method according to claim 22, wherein the flowing a fluid comprises flowing low pressure, low flow rate water.

* * * * *